US006049202A

United States Patent [19]

Poplevine et al.

[11] Patent Number: 6,049,202

[45] **Date of Patent: *Apr. 11, 2000**

[54] REFERENCE CURRENT GENERATOR WITH GATED-DIODES

[75] Inventors: Pavel Poplevine, Foster City; Alexander Kalnitsky, San Francisco; Albert Bergemont, Palo Alto, all of Calif.

[73] Assignee: National Semiconductor Corporation, Santa Clara, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/191,140

[22] Filed: Nov. 13, 1998

[51] Int. Cl.[7] ..... G05F 3/16; G05F 3/02

[52] U.S. Cl. ..... 323/313; 323/315; 323/312; 327/541

[58] Field of Search ..... 323/313, 312, 323/315, 311; 327/538, 541

[56] References Cited

U.S. PATENT DOCUMENTS

| | | | |
|---|---|---|---|
| 4,970,415 | 11/1990 | Fitzpatrick et al. | 307/448 |
| 5,362,990 | 11/1994 | Alvarez et al. | 327/538 |
| 5,579,006 | 11/1996 | Hasegawa et al. | 341/162 |
| 5,619,161 | 4/1997 | Novof et al. | 327/535 |
| 5,629,611 | 5/1997 | McIntyre | 323/313 |
| 5,686,822 | 11/1997 | Croft et al. | 323/312 |

OTHER PUBLICATIONS

A. Kalnitsky, et al., "Experimental Investigation of N–MOS Inversion Layers in the Electric Quantum Limit", Journal of Electric Materials, vol. 21, No. 3, (1992) pp. 367–372.

*Primary Examiner*—Adolf Deneke Berhane
*Assistant Examiner*—Rajnikant B. Patel
*Attorney, Agent, or Firm*—Limbach & Limbach L.L.P.

[57] ABSTRACT

A reference current generator outputs a reference current which is insensitive to temperature variations by utilizing two gated diodes to output currents. The currents output by the gated diodes are divided to produce the reference current which, due to the cancellation of terms, is defined by the ratio of the gate areas of the gated diodes. In addition, by utilizing two oscillators, which run at different frequencies, to drive the gated diodes, the reference current may alternately be defined by the ratio of the two frequencies.

24 Claims, 4 Drawing Sheets

REFERENCE CURRENT GENERATOR WITH GATED-DIODES

BACKGROUND OF THE INVENTION

1. Field of the Invention.

The present invention relates to a reference current generator and, more particularly, to a reference current generator with gated-diodes.

2. Description of the Related Art.

An ideal reference current generator is a circuit which outputs a current that remains constant over variations in temperature. In actual practice, however, reference current generators typically output currents that fall within a narrow range of values over a range of temperatures.

FIG. 1 shows a schematic diagram that illustrates a conventional current generator 100. As shown in FIG. 1, generator 100, which is commonly referred to as a current mirror, includes a diode-connected p-channel transistor 110 which is connected to a power supply node VCC.

In addition, generator 100 also includes a diode-connected n-channel transistor 112 which is connected to transistor 110 and ground, and a mirror transistor 114 which is connected to transistor 112 and ground.

In operation, a current $I_1$ is forced to flow through diode-connected transistors 110 and 112.

Current $I_1$. in turn, sets up the gate-to-source voltage $V_{GS}$ for both transistors 112 and 114 which causes a reference current $I_{REF}$ to be sunk by transistor 114.

One of the disadvantages of generator 100, however, is that the magnitude of the reference current $I_{REF}$ typically has a large variation over changes in temperature. Thus, there is a need for a reference current generator which is insensitive to changes in temperature.

SUMMARY OF THE INVENTION

The present invention provides a reference current generator that is insensitive to temperature variations. The reference current generator of the present invention, which is formed in a semiconductor material of a first conductivity type, includes a first oscillator that outputs a first pulse train. The first pulse train has a first frequency and a first amplitude.

The generator also includes a first gated diode that is connected to the first oscillator to receive the first pulse train, and a second gated diode. The generator further includes a first output diode that is connected to the first gated diode, and a second output diode that is connected to the second gated diode.

Additionally, the generator includes a reference circuit that has a first port connected to the first output diode, a second port connected to the second output diode, a third port connected to ground, and a fourth port that outputs a reference current. The reference circuit outputs the reference current in response to a first current flowing into the first port and a second current flowing into the second port.

In a first embodiment of the present invention, the reference circuit divides the first current by the second current to form the reference current. In this embodiment, the gate area of the first gated diode is different from the gate area of the second gated diode.

In an alternate of the first embodiment, the generator also includes a second oscillator that outputs a second pulse train. In this alternate, the second gated diode is connected to the second oscillator to receive the second pulse train. The second pulse train has a second frequency which is different from the first frequency.

In another alternate of the first embodiment, the gate areas of the gated diodes are substantially the same, but the first and second frequencies are different.

In a second embodiment of the present invention, the reference circuit subtracts the first current from the second current to form the reference current. In this embodiment, the second gated diode is also connected to a second oscillator that outputs a second pulse train. The second pulse train has a frequency that is the same as the frequency of the first pulse train, but an amplitude which is different from the amplitude of the first pulse train.

A better understanding of the features and advantages of the present invention will be obtained by reference to the following detailed description and accompanying drawings which set forth an illustrative embodiment in which the principals of the invention are utilized.

DETAILED DESCRIPTION

Figure 1:
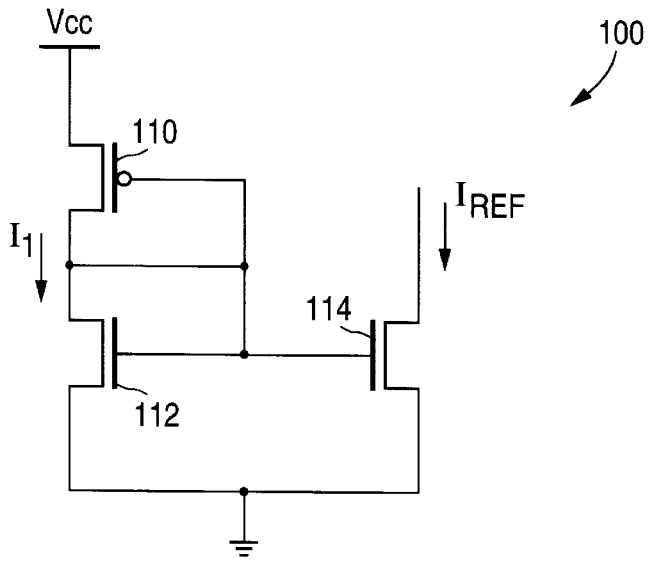
FIG. 1 (PRIOR ART)
FIG. 1 is a schematic diagram illustrating a conventional current generator 100.
Figure 2:
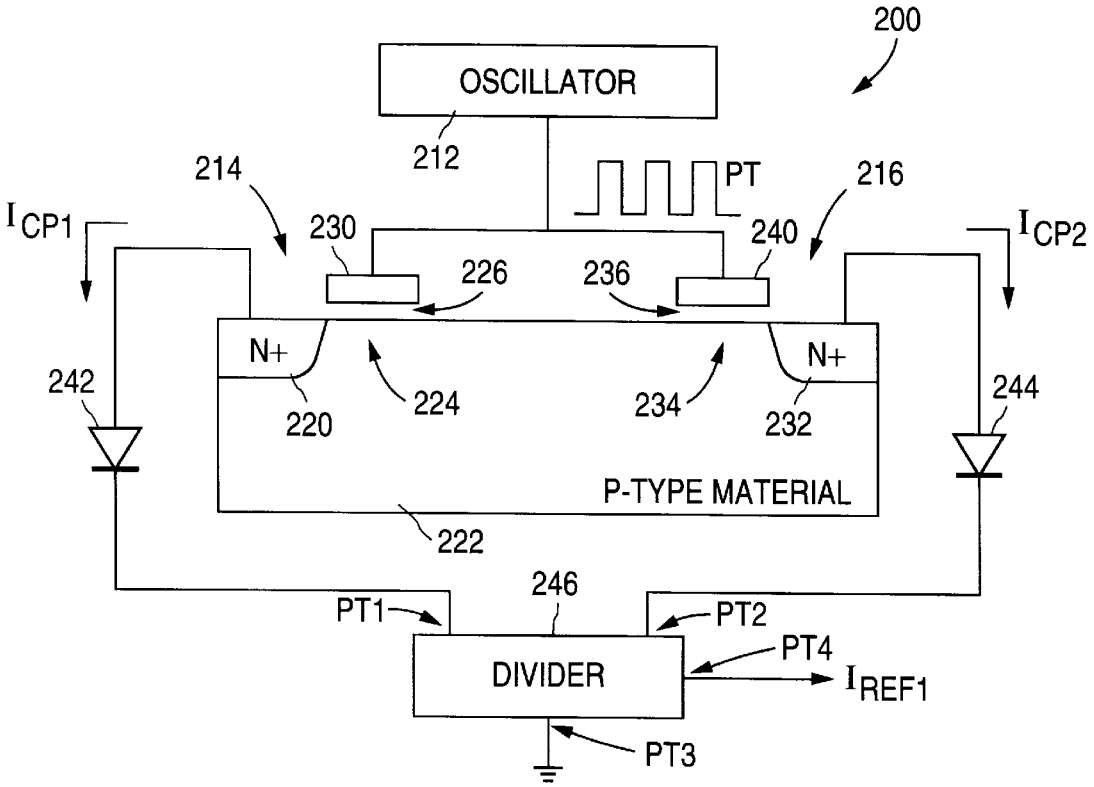
FIG. 2 is a cross-sectional and schematic diagram illustrating a reference current generator 200 in accordance with the present invention.

FIG. 2 shows a cross-sectional and schematic drawing that illustrates a reference current generator 200 in accordance with the present invention. As described in greater detail below, the present invention forms a reference current by utilizing gated-diodes.

As shown in FIG. 2, generator 200 includes an oscillator 212 that outputs a pulse train PT, and first and second gated diodes 214 and 216 which are connected to oscillator 212 to receive pulse train PT. Gated diode 214, in turn, includes a n+ diffusion region 220 which is formed in a p-type material 222, such as a well or a substrate, and an inversion region 224 which is defined in material 222 adjacent to diffusion region 220. In addition, gated diode 214 also includes a layer of oxide 226 which is formed over inversion region 224, and a diode gate 230 which is formed on oxide layer 226 over inversion region 224.

Similarly, gated diode 216 includes a n+diffusion region 232 which is formed in p-type material 222, and an inversion region 234 which is defined in material 222 adjacent to diffusion region 232. In addition, gated diode 216 also includes a layer of oxide 236 which is formed over inversion region 234, and a diode gate 240 which is formed on oxide layer 236 over inversion region 234. In accordance with the present invention, gate 230 and gate 240 are formed to have different gate areas.

As further shown in FIG. 2, generator 200 also includes first and second output diodes 242 and 244 which are connected to diffusion regions 220 and 232, and a current divider 246. Current divider 246 has a first port PT1 which is connected to diode 242, a second port PT2 which is connected to diode 244, a third port PT3 which is connected to ground, and a fourth port PT4 that outputs a reference current $I_{REF1}$.

In operation, each time the pulse train PT transitions from a logic low to a logic high, a positive potential is capacitively coupled to the surface of material 222 under gates 230 and 240 which, in turn, lowers the potential barriers across the diffusion region 220-to-material 222 junction and the diffusion region 232-to-material 222 junction. (Since the positive pulses are applied to gates, the positive pulses may be generated by on-board charge pumps as the charge pumps do not need to sustain a large current flow.)

As a result, electrons flow from ground through divider 246 through diode 242 to diffusion region 220 where the electrons are injected into material 222. The injected electrons are attracted to the surface of material 222 under gate 230 where the electrons form an inversion layer in inversion region 224.

Similarly, electrons also flow from ground through divider 246 through diode 244 to diffusion region 232 where the electrons are injected into material 222. As above, the injected electrons are also attracted to the surface of material 222 where the electrons form an inversion layer in inversion region 234.

At the same time, mobile holes flow from material 222 through diffusion region 220 and diode 242 to divider 246, while mobile holes also flow from material 222 through diffusion region 232 and diode 244 to divider 246.

When the voltage on gates 230 and 240 is returned to ground, the electrons in material 222 (except for the electrons that are within a diffusion length of the junction depletion regions) are forced to recombine with the majority carriers (holes) in material 222 (diodes 242 and 244 prevent the electrons from returning to ground). As a result of the recombination, the negative charge that was injected into material 222 is removed.

The negative charge Qi1 that was injected into material 222 from diffusion region 220 during the pulse (the steady-state charge in the inversion layer) is given by EQ. 1 as:

$$Qi1=Cox1*A1*(Vg1-Vt1) \quad \text{EQ. 1}$$

where Cox1 is the gate oxide capacitance per unit area, A1 is the area of diode gate 230, Vg1 is the voltage applied to diode gate 230, and Vt1 is the threshold voltage of gated diode 214.

Similarly, the negative charge Qi2 that was injected into material 222 from diffusion region 232 during the pulse (the steady-state charge in the inversion layer) is given by EQ. 2 as:

$$Qi2=Cox2*A2*(Vg2-Vt2) \quad \text{EQ. 2}$$

where Cox2 is the gate oxide capacitance per unit area, A2 is the area of diode gate 240, Vg2 is the voltage applied to diode gate 240, and Vt2 is the threshold voltage of gated diode 216.

When pulse train PT is used, the above-described process is repeated for each positive pulse which gives rise to first and second charge pumping currents $I_{CP1}$ and $I_{CP1}$ which flow into the first and second ports PT1 and PT2, respectively, of divider 246. The first and second charge pumping currents $I_{CP1}$ and $I_{CP2}$ are defined by EQs. 3 and 4, respectively, as:

$$I_{CP1}=f*Qi1 \quad \text{EQ. 3}$$

$$I_{CP2}=f*Qi2 \quad \text{EQ. 4}$$

where f is the frequency of pulse train PT.

The linear relationship between the frequency f and the charge pumping currents $I_{CP1}$ and $I_{CP2}$ exists if the frequency f is sufficiently low for effective complete recombination of charges Qi1 and Qi2 to occur between pulse applications. The linear relationship holds up to frequencies of several megahertz at room temperature.

For a given amplitude of pulse train PT, the charge pumping currents $I_{CR1}$ and $I_{CP2}$ increase with increasing temperature. In addition, the linear relationship will be extended due to enhanced charge recombination that occurs with increasing temperature. The desired magnitude of the charge injection per pulse is achieved by appropriately sizing inversion regions 224 and 234 (including gate;s 230 and 240) and selecting the amplitude of pulse train PT.

In accordance with the present invention, divider 246 outputs the reference current $I_{REF1}$ by dividing the first and second currents $I_{CP1}$ and $I_{CP2}$ as shown in EQ. 5:

$$I_{REF1}=I_{CP1}/I_{CP2}=A1/A2. \quad \text{EQ. 5}$$

Thus, as shown in EQ. 5, due to the cancellation of terms, the reference current $I_{REF1}$ output by divider 246 is insensitive to temperature variations, and is defined by the ratios of the two gate areas A1/A2.

Figure 3:
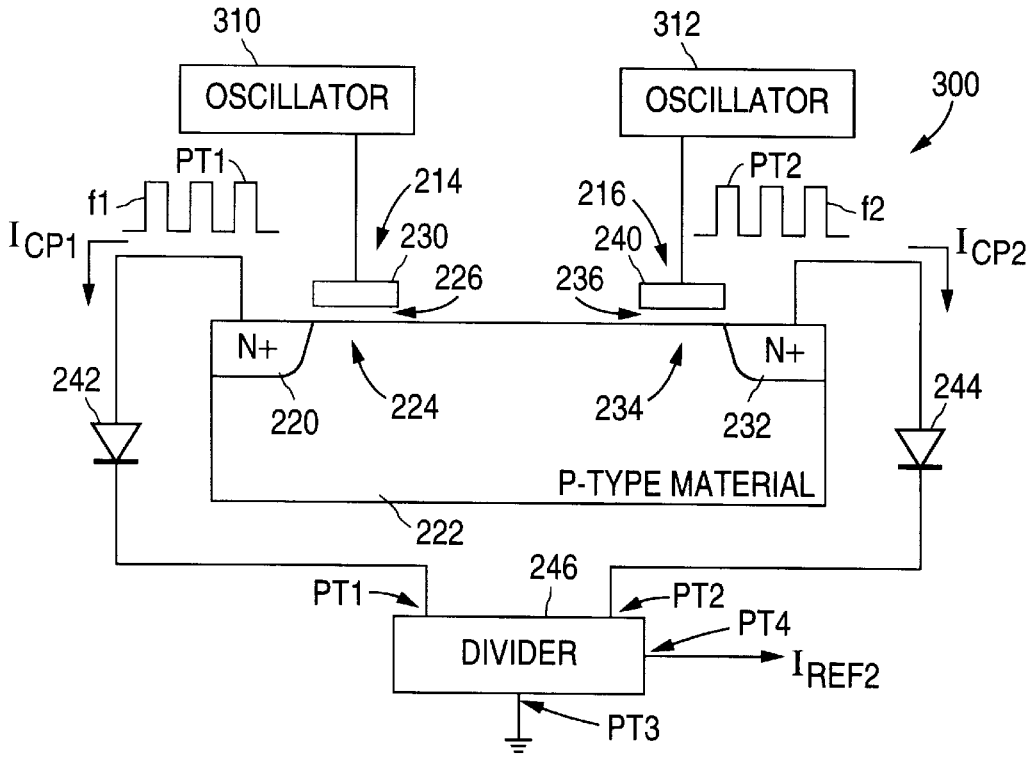
FIG. 3 is a cross-sectional and schematic drawing illustrating a reference current generator 300 in accordance with a first alternate embodiment of the present invention.

FIG. 3 shows a cross-sectional and schematic drawing that illustrates a reference current generator 300 in accordance with a first alternate embodiment of the present invention. Generator 300 and generator 200 are similar and, as a result, utilize the same reference numerals to designate the structures which are common to both generators.

As shown in FIG. 3, generator 300 differs from generator 200 in that generator 300 utilizes a first oscillator 310 which is connected to gate 230, and a second oscillator 312 which is connected to gate 240. First oscillator 310 outputs a first pulse train PT1 which has a first frequency f1, while second oscillator 312 outputs a second pulse train PT2 which has a second frequency f2 which is different from first frequency f1. In addition, generator 300 also differs from generator 200 in that the gate areas A1 and A2 of diode gates 230 and 240, respectively, are the same.

In accordance with the present invention, divider 246 of generator 300 outputs a reference current $I_{REF2}$ by again dividing the first and second currents $I_{CP1}$ and $I_{CP2}$ as shown in EQ. 6:

$$I_{REF2}=I_{CP1}/I_{CP2}=f1/f2. \quad \text{EQ. 6}$$

Thus, as shown in EQ. 6, due to the cancellation of terms, the reference current $I_{REF2}$ output by divider 246 is insensitive to temperature variations, and is defined by the ratios of the two frequencies f1 and f2.

Figure 4:
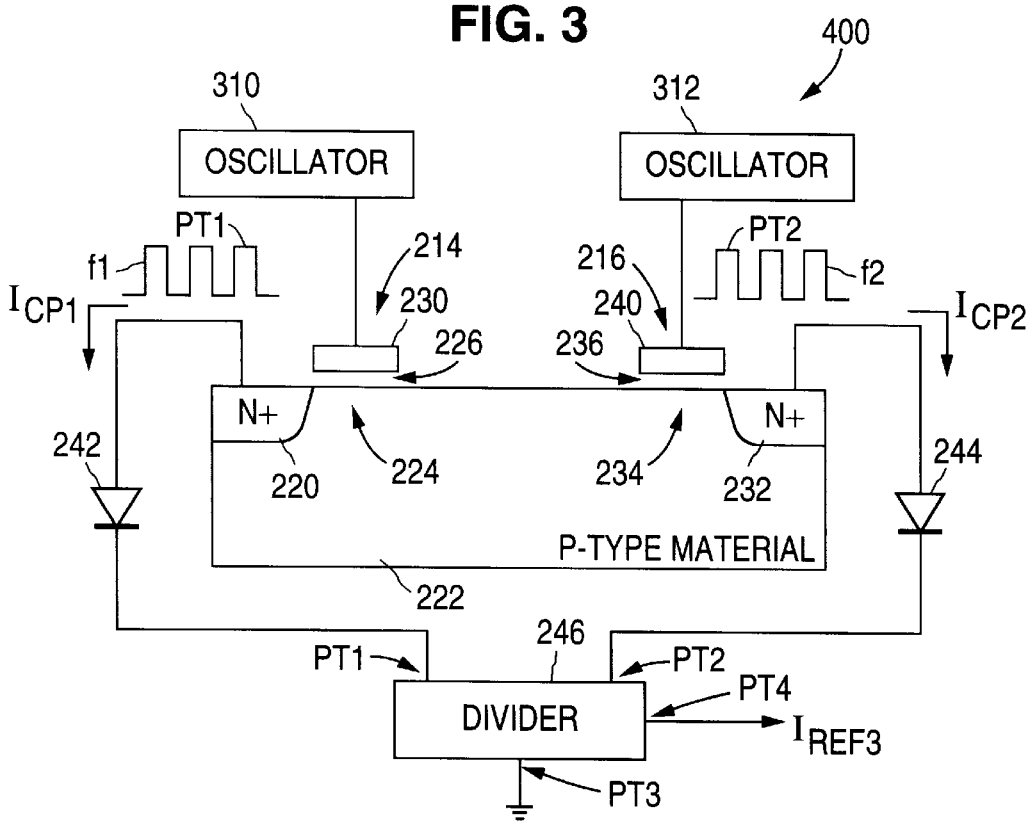
FIG. 4 is a cross-sectional and schematic drawing illustrating a reference current generator 400 in accordance with a second alternate embodiment of the present invention.
Figure 5:
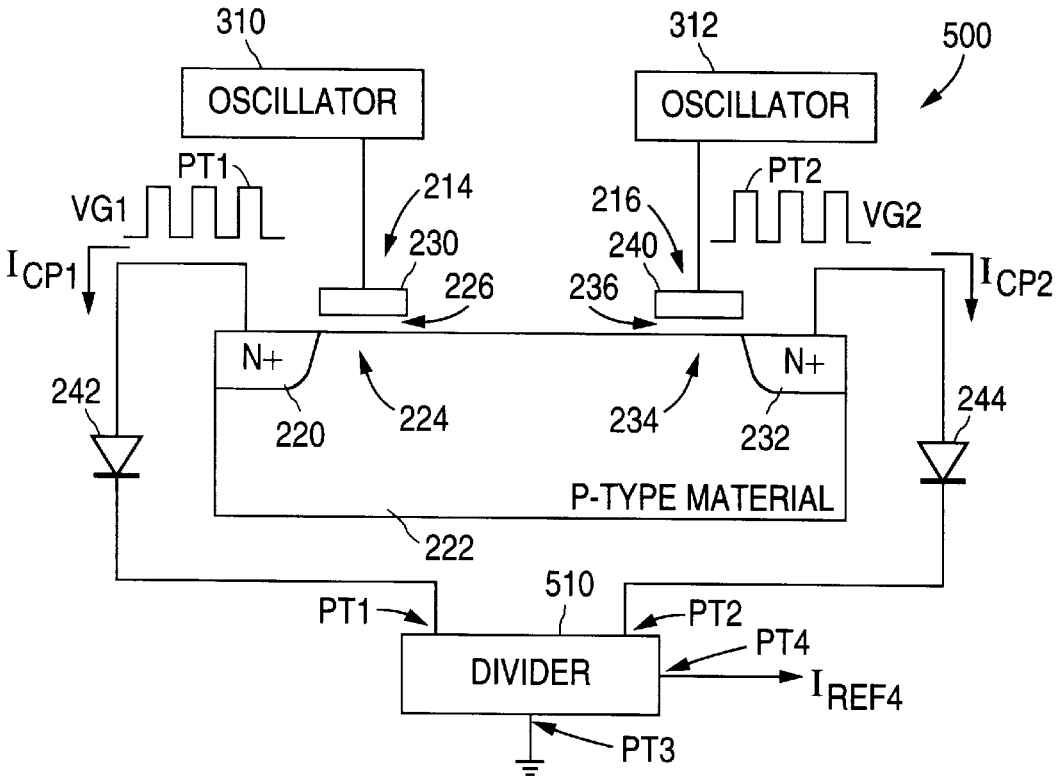
FIG. 5 is a cross-sectional and schematic drawing illustrating a reference current generator 500 in accordance with a third alternate embodiment of the present invention.

FIG. 4 shows a cross-sectional and schematic drawing that illustrates a reference current generator 400 in accordance with a second alternate embodiment of the present invention. Generator 400 and generator 300 are similar and, as a result, utilize the same reference numerals to designate the structures which are common to both generators. Generator 400 differs from generator 300 in that the areas A1 and A2 of generator 400 are different.

In accordance with the present invention, divider 246 of generator 400 outputs a reference current $I_{REF3}$ by dividing the first and second currents $I_{CP1}$ and $I_{CP2}$ as shown in EQ. 7:

$$I_{REF3}=I_{CP1}/I_{CP2}=(f1)\ (A1)/(f2)\ (A2). \qquad \text{EQ. 7}$$

Thus, as shown in EQ. 7, due to the cancellation of terms, the reference current $I_{REF3}$ output by divider 246 is insensitive to temperature variations, and is defined by the ratios of the two frequencies f1 and f2 and the two gate areas Al and A2.

FIG. S shows a cross-sectional and schematic drawing that illustrates a reference current generator 500 in accordance with a third alternate embodiment of the present invention. Generator 500 and generator 300 are similar and, as a result, utilize the same reference numerals to designate the structures which are common to both generators.

Generator 500 differs from generator 300 in that a current difference operational amplifier (subtractor) circuit 510 is used in lieu of divider 246. (A current mirror circuit may alternately be used in lieu of op amp 510.) Generator 500 also differs from generator 300 in that, although the frequencies f1 and f2 are the same, the pulse amplitude Vg1 of first pulse train PT1 is different from the pulse amplitude Vg2 of second pulse train PT2.

In accordance with the present invention, circuit 510 of generator 500 outputs a reference current $I_{REF4}$ by subtracting the first current $I_{CP1}$ from the second current $I_{CP2}$ as shown in EQ. 8:

$$I_{REF4}=I_{CP1}-I_{CP2}=(Vg1)-(Vg2). \qquad \text{EQ. 8}$$

Thus, as shown in EQ. 8, after reducing the expression, the reference current $I_{REF4}$ output by circuit 510 is defined by the difference between the amplitudes of the two gate voltages.

Figure 6:
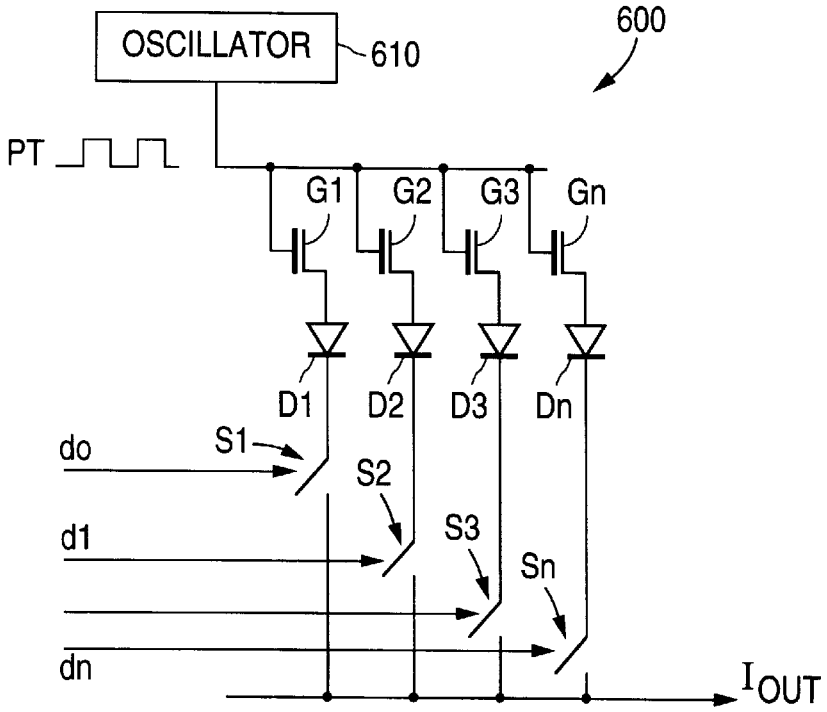
FIG. 6 is a schematic diagram illustrating a digital code to current converter circuit 600 in accordance with the present invention.

FIG. 6 shows a schematic diagram that illustrates a digital code-to-current converter circuit 600 in accordance with the present invention. As shown in FIG. 6, circuit 600 includes an oscillator 610 that outputs a pulse train PT, and a series of gated diodes G1–Gn that are connected to oscillator 610.

In addition, as further shown in FIG. 6, circuit 600 also includes a series of output diodes D1–Dn which are connected to gated diodes G1–Gn such that each output diode D is connected to a corresponding gated diode G, and a series of switches S1–Sn which are connected to output diodes D1–Dn such that each switch S is connected to a corresponding output diode D.

Further, each gated diode G in the series G1-Gn has an incrementally increasing count position x, beginning with zero, such that the gate area of each successive gated diode G in the series is equal to $A2^x$ where A is a constant. For example, the first gated diode GI has a gate area A ($A2^0$), the second gated diode G2 has a gate area 2A ($A2^1$), the third gated diode G3 has a gate area 4A ($A2^2$), and so on.

In operation, the logic ones (or the logic zeros) of a digital code d0–dn cause selected switches S1–Sn to close. The currents from the closed switches are then summed and output as an output current $I_{OUT}$ that has a magnitude that represents the digital code.

Figure 7:
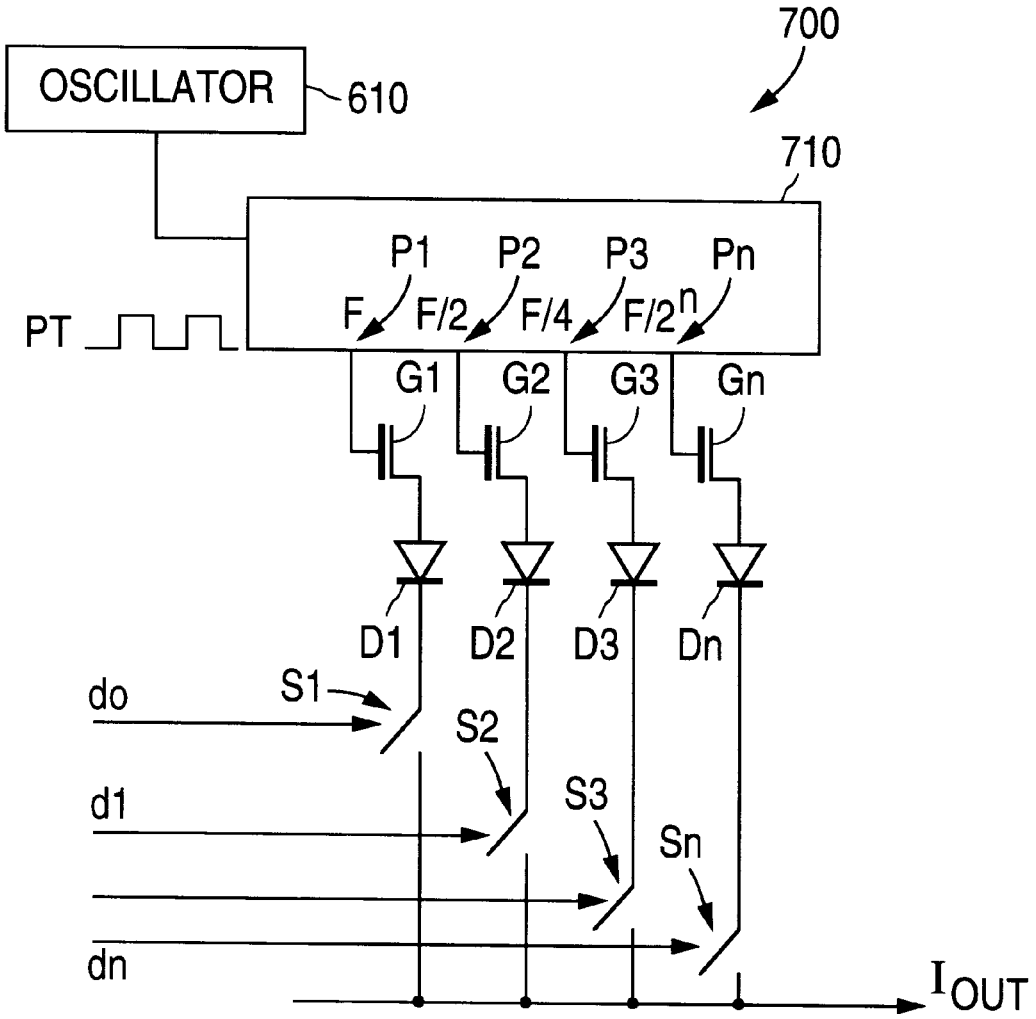
FIG. 7 is a cross-sectional and schematic drawing illustrating a digital code to current converter circuit 700 in accordance with an alternate embodiment of the present invention.

FIG. 7 shows a cross-sectional and schematic drawing that illustrates a digital code to current converter circuit 700 in accordance with an alternate embodiment of the present invention. Circuit 700 and circuit 600 are similar and, as a result, utilize the same reference numerals to designate the structures which are common to both circuits.

Circuit 700 differs from circuit 600 in that a frequency divider 710 is positioned between oscillator 610 and the gated diodes G1–Gn. As shown in FIG. 7, frequency divider 710 has a number of output ports P1–Pn that correspond to the number of gated diodes G1–Gn.

Further, each port P has an incrementally increasing count position x, beginning with zero, such that the frequency output by each successive port P is $F/2^x$ where F is a constant. For example, the first port P1 outputs a pulse train having a frequency equal to F ($F/2^0$), the second port P2 outputs a pulse train having a frequency equal to F/2 ($F/2^1$), the third port P3 outputs a pulse train having a frequency equal to F/4 ($F/2^2$), and so on.

In operation, the logic ones (or the logic zeros) of a digital code d0–dn cause selected switches S1–Sn to close. The currents from the closed switches are then summed and output as an output current $I_{OUT}$ that has a magnitude that represents the digital code.

It should be understood that various alternatives to the embodiment of the invention described herein may be employed in practicing the invention. Thus, it is intended that the following claims define the scope of the invention and that methods and structures within the scope of these claims and their equivalents be covered thereby.

What is claimed is:

1. A reference current generator formed in a semiconductor material of a first conductivity type, the generator comprising:

a first oscillator that outputs a first pulse train, the first pulse train having a first frequency and a first amplitude;

a first gated diode connected to the first oscillator to receive the first pulse train;

a second gated diode;

a first output diode connected to the first gated diode;

a second output diode connected to the second gated diode; and a reference circuit having a first port connected to the first output diode, a second port connected to the second output diode, a third port connected to ground, and a fourth port that outputs a reference current, the reference circuit outputting the reference current in response to a first current flowing into the first port and a second current flowing into the second port.

2. A reference current generator formed in a semiconductor material of a first conductivity type, the generator comprising:

a first oscillator that outputs a first pulse train, the first pulse train having a first frequency and a first amplitude;

a first gated diode connected to the first oscillator to receive the first pulse train;

a second gated diode;

a first output diode connected to the first gated diode;

a second output diode connected to the second gated diode; and a reference circuit having a first port connected to the first output diode, a second port connected to the second output diode, a third port connected to ground, and a fourth port that outputs a reference current, the reference circuit outputting the reference current in response to a first current flowing into the first port and a second current flowing into the second port, the reference circuit dividing the first current by the second current to form the reference current.

3. The generator of claim 2 wherein the first gated diode includes:

a first diffusion region of a second conductivity type formed in the material;

a first inversion region defined in the material adjacent to the first diffusion region;

a layer of first oxide formed over the first inversion region; and a first diode gate formed on the first oxide layer over the first inversion region, the first diode gate being connected to the first oscillator and having a first area.

4. The generator of claim 3 wherein the second gated diode includes:

a second diffusion region of the second conductivity type formed in the material;

a second inversion region defined in the material adjacent to the second diffusion region;

a layer of second oxide formed over the second inversion region; and a second diode gate formed on the second oxide layer over the second inversion region, the second diode gate having a second area.

5. The generator of claim 4 wherein the first area and the second area are different.

6. The generator of claim 5 wherein the second gated diode is connected to the first oscillator to receive the first pulse train.

7. The generator of claim 5 wherein the first oxide and the second oxide are different.

8. The generator of claim 7 and further comprising a second oscillator that outputs a second pulse train, the second gated diode being connected to the second oscillator to receive the second pulse train, the second pulse train having a second frequency.

9. The generator of claim 8 wherein the first frequency and the second frequency are different.

10. The generator of claim 9 wherein the first oxide and the second oxide are different.

11. The generator of claim 2 and further comprising a second oscillator that outputs a second pulse train, the second gated diode being connected to the second oscillator to receive the second pulse train, the second pulse train having a second frequency.

12. The generator of claim 11 wherein the first frequency and the second frequency are different.

13. A reference current generator formed in a semiconductor material of a first conductivity type, the generator comprising:

a first oscillator that outputs a first pulse train, the first pulse train having a first frequency and a first amplitude;

a first gated diode connected to the first oscillator to receive the first pulse train;

a second oscillator that outputs a second pulse train, the second pulse train having a second frequency and a second amplitude;

a second gated diode, the second gated diode being connected to the second oscillator to receive the second pulse train;

a first output diode connected to the first sated diode;

a second output diode connected to the second gated diode; and a reference circuit having a first port connected to the first output diode, a second port connected to the second output diode, a third port connected to ground, and a fourth port that outputs a reference current, the reference circuit outputting the reference current in response to a first current flowing into the first port and a second current flowing into the second port.

14. The generator of claim 13 wherein the reference circuit subtracts the first current from the second current to form the reference current.

15. The generator of claim 14 wherein the first amplitude and the second amplitude are different.

16. The generator of claim 15 wherein the first oxide and the second oxide are different.

17. A digital code to current converter circuit comprising:

an oscillator that outputs a pulse train;

a plurality of gated diodes connected to the oscillator to receive the pulse train, each gate diode having:

a first diffusion region of a second conductivity type formed in the material;

a first inversion region defined in the material adjacent to the first diffusion region;

a layer of first oxide formed over the first inversion region; and a first diode gate formed on the first oxide layer over the first inversion region, the first diode gate being connected to the first oscillator and having a gate area, the gate area of each gated diode being different;

a plurality of output diodes connected to the gated diodes such that each output diode is connected to a corresponding gated diode; and a plurality of switches connected to the output diodes such that each switch is connected to a corresponding output diode.

18. The converter circuit of claim 17 wherein each gated diode is assigned an incrementally increasing count position x, beginning with zero, and wherein each successive gate area is $A2^x$ where A is a constant.

19. A digital code to current converter circuit comprising:

an oscillator that outputs a pulse train;

a frequency divider connected to the oscillator to receive the pulse train, the divider having a plurality of output ports, each output port outputting the pulse train with a different frequency;

a plurality of gated diodes connected to the frequency divider such that each gated diode is connected to a corresponding port;

a plurality of output diodes connected to the gated diodes such that each output diode is connected to a corresponding gated diode; and a plurality of switches connected to the output diodes such that each switch is connected to a corresponding output diode.

20. The converter circuit of claim 19 wherein each port is assigned an incrementally increasing count position x, beginning with zero, and wherein each successive frequency is $F/2^x$ where F is a constant.

21. The circuit of claim 17 wherein each switch is connected to receive a signal having a logic state, the switch being open when the logic state is in a first state, and being closed when the logic state is in a second state.

22. The circuit of claim 17 wherein the switches each have an output node that are connected together.

23. The circuit of claim 19 wherein each switch is connected to receive a signal having a logic state, the switch being open when the logic state is in a first state, and being closed when the logic state is in a second state.

24. The circuit of claim 19 wherein the switches each have an output node that are connected together.

* * * * *

UNITED STATES PATENT AND TRADEMARK OFFICE

CERTIFICATE OF CORRECTION

PATENT NO. : 6,049,202
DATED : April 11, 2000
INVENTOR(S) : Pavel Poplevine, et. al.

It is certified that error appears in the above-identified patent and that said Letters Patent is hereby corrected as shown below:

Column 7, line 61, after "first" delete "sated" and substitute therefor--gated--.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*